US006947570B2

(12) United States Patent
Maisano

(10) Patent No.: US 6,947,570 B2
(45) Date of Patent: Sep. 20, 2005

(54) METHOD FOR ANALYZING AN ACOUSTICAL ENVIRONMENT AND A SYSTEM TO DO SO

(75) Inventor: Joseph Maisano, Neuchâtel (CH)

(73) Assignee: Phonak AG, Stafa (CH)

( * ) Notice: Subject to any disclaimer, the term of this patent is extended or adjusted under 35 U.S.C. 154(b) by 779 days.

(21) Appl. No.: 09/837,050

(22) Filed: Apr. 18, 2001

(65) Prior Publication Data

US 2002/0181720 A1 Dec. 5, 2002

(51) Int. Cl.[7] ..... H04R 25/00; H04R 3/00
(52) U.S. Cl. ..... 381/313; 381/92
(58) Field of Search ..... 381/313, 312, 381/92

(56) References Cited

U.S. PATENT DOCUMENTS 5,664,014 A * 9/1997 Yamaguchi et al. ..... 379/430
6,002,645 A 12/1999 Booth
2001/0031053 A1 * 10/2001 Feng et al. ..... 381/92
2002/0034310 A1 * 3/2002 Hou ..... 381/92

FOREIGN PATENT DOCUMENTS

EP 0 802 699 A 10/1997
WO 95 20305 7/1995

* cited by examiner

*Primary Examiner*—Stella Woo
(74) *Attorney, Agent, or Firm*—Pearne & Gordon LLP

(57) ABSTRACT

Acoustical signals are registered at two locations to generate two electric signals. Based on the electric signals, the distance from one of the locations to the source of the acoustical signal is calculated to generate a distance signal. The distance signal is amplitude filtered to generate a patterned distance signal. A signal dependent from the electric signal is weighed by the patterned distance signal to generate an output signal representing the acoustical signal from source distributed in an environment within a distance pattern.

16 Claims, 4 Drawing Sheets

METHOD FOR ANALYZING AN ACOUSTICAL ENVIRONMENT AND A SYSTEM TO DO SO

BACKGROUND OF THE INVENTION

Brief Summary of the Invention

The present invention departs from the needs which are encountered in hearing aid technology. Nevertheless, although especially directed to this hearing aid technology, the present invention may be applied to the art of registering acoustical signals more generically.

Current beam formers allow only weighing of incoming acoustical signals according to the spatial direction wherefrom an acoustical signal impinges on an acoustical to electrical converter arrangement.

Besides of generating such spatial angle weighing—beam forming—by means of one respectively ordered acoustical to electrical converter, it is known to provide for such weighing an array of converters, microphones, with at least two microphones. They are located mutually distant by a given distance.

For instance in the hearing aid art it is possible to adapt spatial angle dependent weighing by means of no-called beam forming, so as to eliminate noise from unwanted impinging directions. This enhances the individual's ability to perceive an acoustical signal source situated in a predetermined angular range with respect to the one or—in case of binaural hearing aid—to the two hearing aid apparatuses. Usually by such weighing function acoustical signals are primarily cancelled as impinging from behind the individual.

As current beam formers, especially on hearing aid apparatus, have only an angularly varying response, it occurs in some acoustical environments, as e.g. at a cocktail party, that even if the reception directivity is highs the speech from a target direction is unintelligible due to superposition of different talkers located in the same direction with respect to the individual carrying the hearing aid apparatus.

It is therefore an object of the present invention to provide for a method for discriminating impinging acoustical signals not only as a function of the angular impinging direction, but also as a function of the distance of an acoustical signal's source from the hearing aid-equipped individual.

More generically, it is an object of the present invention to provide for a method and apparatus for distance-selective monitoring of acoustical signals. It is in a preferred embodiment, as especially for hearing aid apparatus, that the present invention of distance-selective registration of acoustic signals is combined with direction-selective registration of such signals.

By such combining it becomes possible to locate an acoustical source in the acoustical environment, which might be important for non-hearing aid appliances, and for hearing aid appliances it becomes possible to focus reception on a desired source of acoustical signals, as on a specific speaker.

The object of the present invention is realized by a method for analyzing an acoustical environment, which comprises registering acoustical signals at at least two reception locations, which are mutually distant by a given distance and generating at least two respective first electric signals representing the acoustical signal;

calculating electronically from said first electric signals at least one of the distances of sources of acoustical signals with respect to at least one of said locations, thereby generating a distance signal;

amplitude filtering the distance signal, thereby generating a patterned distance signal;

weighing a signal, which is dependent from at least one of said first electric signals by the patterned distance signal, thereby generating an output signal representing the acoustical signals from sources distributed in the acoustical environment within a distance pattern.

In a preferred mode of operation, calculation and thereby generation of the distance signal is performed according to preferred signal processing, as will be explained in more details in the detailed description part of the present description.

The second signal, which is inventively weighed by the patterned distance signal, may be directly one of the first electric signals, if only distance discrimination of an acoustical source in the acoustical surrounding is of interest. If on the other hand one desires to maintain directivity selection, then the second signal is an output signal of a directivity beam former as is known in the art and which provides for a directivity, possibly an adjustable transmission beam. Especially in view of the last mentioned combination it becomes evident that the case may arise, where selectively not only acoustical sources shall be registered in one single distance, but simultaneously from more than one predetermined distances. Therefore, the amplitude filtering may be performed with a respective filtering function, e.g. according to a comb filter, but in a preferred embodiment amplitude filtering is performed by one band-pass amplitude filtering, thereby passing amplitude values within a predetermined amplitude band. Thereby, as the second signal is weighed, therewith only signals are output representing acoustical sources located in one distance in the acoustical environment.

As was mentioned, in a further most preferred embodiment of the inventive method, the signal dependent from the first electric signals is generated by weighing the first electric signals in dependency of the fact under which spatial angle the respective acoustical signals impinge at the at least two reception locations.

Especially with an eye on implementing the inventive method on hearing aid appliances, it is further preferred to perform amplitude filtering with an adjustable filter characteristic. Thereby and especially with an eye on providing one band-pass amplitude filtering, the individual with a hearing aid apparatus inventively construed may adjust amplitude filtering, e.g. by means of remote control, to fit to an instantaneous need of hearing, especially a specific source of acoustical signals, as a specific speaker.

In the case of the preferred implementation of the inventive method to a hearing aid apparatus or to two hearing aid apparatuses of a binaural hearing aid system, at least two microphones of the one hearing aid apparatus and/or at least two microphones, each one of the ear-specific microphones of the binaural hearing aid system, are exploited for acoustical signal reception at the at least two mutually distant reception locations.

In a further, clearly preferred realization form of the inventive method, the first electric signals are generated as digital signals, and further preferred by additional time to frequency domain conversion.

The inventive system for analyzing an acoustical environment comprises:

At least two acoustical to electrical converter, which are mutually distant by a predetermined distance and which generate respective first electric output signals at at least two outputs of said converters;

a calculating unit, the inputs thereof being operationally connected to the outputs of the converters and generating at an output a signal which is representative of a distance of an acoustical source in said environment with respect to one of said acoustical to electrical converters;

an amplitude filter unit with an input operationally connected to the output of the calculating unit and generating at an output an output signal which is dependent from a signal to the input of the filter unit, weighed by a function which is dependent from the amplitude of said input signals;

a weighing unit with at least two inputs, one thereof being operationally connected to the output of the amplitude filter unit and the second input thereof being operationally connected to at least one of the outputs of the converters.

Further preferred embodiments or the inventive system become apparent to the skilled artisan especially by the following detailed description of the invention. This is especially with respect to the inventive system being implemented in a single-ear hearing aid device or in a binaural hearing aid system.

BRIEF DESCRIPTION OF THE DRAWINGS

The invention will now be described more in details and by way of examples with the help of figures. They show.

DETAILED DESCRIPTION OF THE PREFERRED EMBODIMENTS OF THE INVENTION

Figure 1:
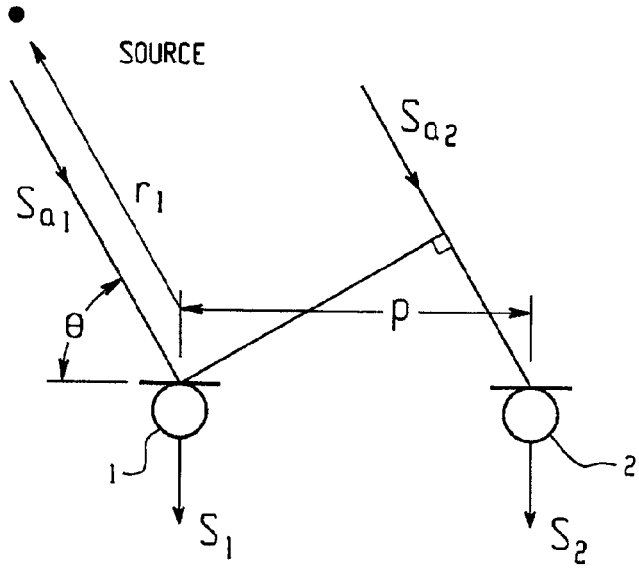
FIG. 1 schematically, two reception locations mutually distant, to explain the reception characteristics enabling the inventive method and system.

In FIG. 1 there are schematically shown two acoustical to electrical converters, microphones 1 and 2 located with a predetermined mutual distance p. If a signal source for the respective acoustical signal $S_{a1}$ and $S_{a2}$ is far away from the two microphones 1 and 2 and relative to their mutual distance p, there may be written:

$$S_1 = S(r_1) = S_0 \frac{1}{r_1} \exp(-jkr_1) \tag{1}$$

$$S_2 = S(r_1 + d) = S_0 \frac{1}{r_1 + d} \exp(-jk(r_1 + d)) \tag{2}$$

respectively for the electric output signals $S_1$ and $S_2$ of the microphones 1, 2. Thereby, there is valid $$d = p\cos(\theta),\ k = \omega/c \tag{3}$$

p being the distance between the microphones, $\omega = 2\pi f$, with f the frequency of impinging acoustical signals $S_{a1}$ and $S_{a2}$ and c the speed of sound in air.

Further, $r_1$ denotes the smaller one of the two distances between the respective microphones 1 and 2 and the acoustical signal source, according to FIG. 1 with respect to microphone 1.

We see that the system (1) and (2) is in fact two equations of two complex values (4 equations) and the unknowns are $S_0$ (complex value), $r_1$ and d forming 4 unknowns. This means that the system is totally defined and solvable.

We then have $$|S_1| = |S_0| \frac{1}{r_1} \tag{4}$$

$$|S_2| = |S_0| \frac{1}{r_1 + d} \tag{5}$$

$$\arg(S_1) = \arg(S_0) + \arg(\exp(-jkr_1)) \tag{6}$$

$$\arg(S_2) = \arg(S_0) + \arg(\exp(-jk(r_1 + d))) \tag{8}$$

From (4) and (5) we have $$\frac{|S_1|}{|S_2|} = \frac{r_1 + d}{r_1} \tag{8}$$

that leads to $$r_1 = \frac{d}{\frac{|S_1|}{|S_2|} - 1} \tag{9}$$

and from (6) and (7)

$$arg(S_1) - arg(S_2) = -arg(\exp(-jkd)) = kd \tag{10}$$

and then $$d = \frac{\arg(S_1) - \arg(S_2)}{k} \tag{11}$$

and from (9)

$$r_1 = \frac{\arg(S_1) - \arg(S_2)}{k\left(\frac{|S_1|}{|S_2|} - 1\right)} \tag{12}$$

It can be observed that when the signal comes from the perpendicular of the microphone array axis, some discontinuities occur in the formulas for $r_1$ because in this case $|S_1 = S_2|$ and d=0. If the beamforming is a $2^{nd}$ order that eliminates the signal from 90°, there is no need to make a distance calculation in this direction, otherwise a third microphone can be used to perform, in the same way, the distance calculation.

In a preferred form of computation we write:

$$\frac{\rangle |S_1| \langle}{\rangle |S_2| \langle} = \left(1 + \frac{|d|}{r_1}\right) \tag{13}$$

The operator >. . . < thereby represents an average over a predetermined time T during which the signal source may be considered as being stationary with respect to the two microphones 1 and 2. From (13) the distance $r_1$ becomes $$r_1 = \frac{|d|\rangle|S_2|\langle}{\rangle|S_1|\langle-\rangle|S_2|\langle} \tag{14}$$

Therefrom, it might be seen that besides of $|d|=p|\cos(\theta)|r_1$ may again be calculated from the two output signals of the microphones 1, 2. Nevertheless, $|d|$ too may be calculated from these output signals e.g. as will be shown. If we apply to the two signals $S_1$ and $S_2$ the function $$G = \frac{2S_1S_2^*}{|S_1|^2 + |S_2|^2} \tag{15}$$

there results for kd<<l, i.e. for a distance between the microphones smaller than the wavelength of the respective acoustical signals impinging and further with $d<<r_1$, i.e. the source being placed in a considerable distance from the two microphones $$d \approx \frac{\mathrm{Im}[G]}{k}. \tag{16}$$

Therefrom, there results with (15)

$$r_1 = \frac{|\mathrm{Im}[G]|}{k}\frac{\rangle|S_2|\langle}{\rangle|S_1|\langle-\rangle|S_2|\langle} \tag{17}$$

It might be seen that $r_1$ is determined by the two signals $S_1$ and $S_2$ at respective frequencies f and with a predetermined distance p and may e.g. be calculated according to (17) too.

Figure 2:
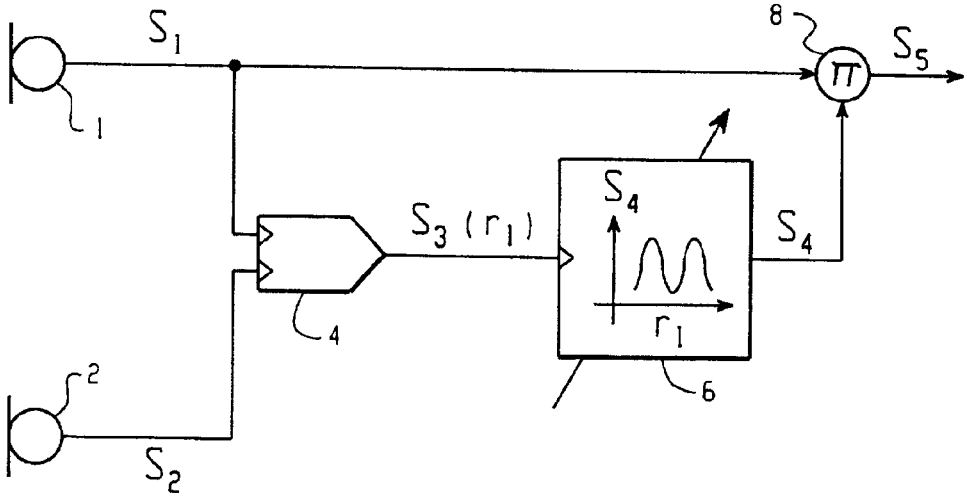
FIG. 2 in a simplified functional block/signal flow diagram an implementation of the inventive method at an inventive system.

In FIG. 2 there is schematically shown implementation of the findings which were explained up to now. The two output signals $S_1$ and $S_2$ of the at least two microphones 1 and 2 are input to a calculation unit 4, which egg. according to the formulas (17) and (15) or (12) calculates the distance $r_1$ and generates accordingly au electric signal $S_3$ ($r_1$). This signal $S_3$ is proportional to the distance $r_1$. The output signal of the calculation unit 4 is applied to the input of an amplitude filter unit 6, which generates an output Signal $S_4$ according to a predetermined filter characteristic or according to a selected or selectable dependency to the magnitude of the input signal $S_3$ and thus of the distance $r_1$.

The output signal $S_4$ of the amplitude filter unit 6 is applied to an input of a weighing unit 8, as e.g. to a multiplication unit, whereat at least one, e.g. the output signal $S_1$ of microphone I and as applied to a second input of the weighing unit 8, is weighed by the output signal $S_4$. Thereby, there is generated at the output of the weighing unit 8 a signal $S_5$ which accords to those parts of signal $S_1$ which are positively amplified by the amplitude filter characteristics of filter unit 6.

If only the components of $S_1$ are of predominant interest, which are generated by an acoustic signal source in one predetermined distance, the filter characteristic of amplitude filter 6 is tailored as a band-pass characteristic. Such a band-pass amplitude filter characteristic is e.g. defined by $$F(f, r_0, r_1)=1/[(r_0-r_1)^n+1] \tag{18}$$

Figure 3:
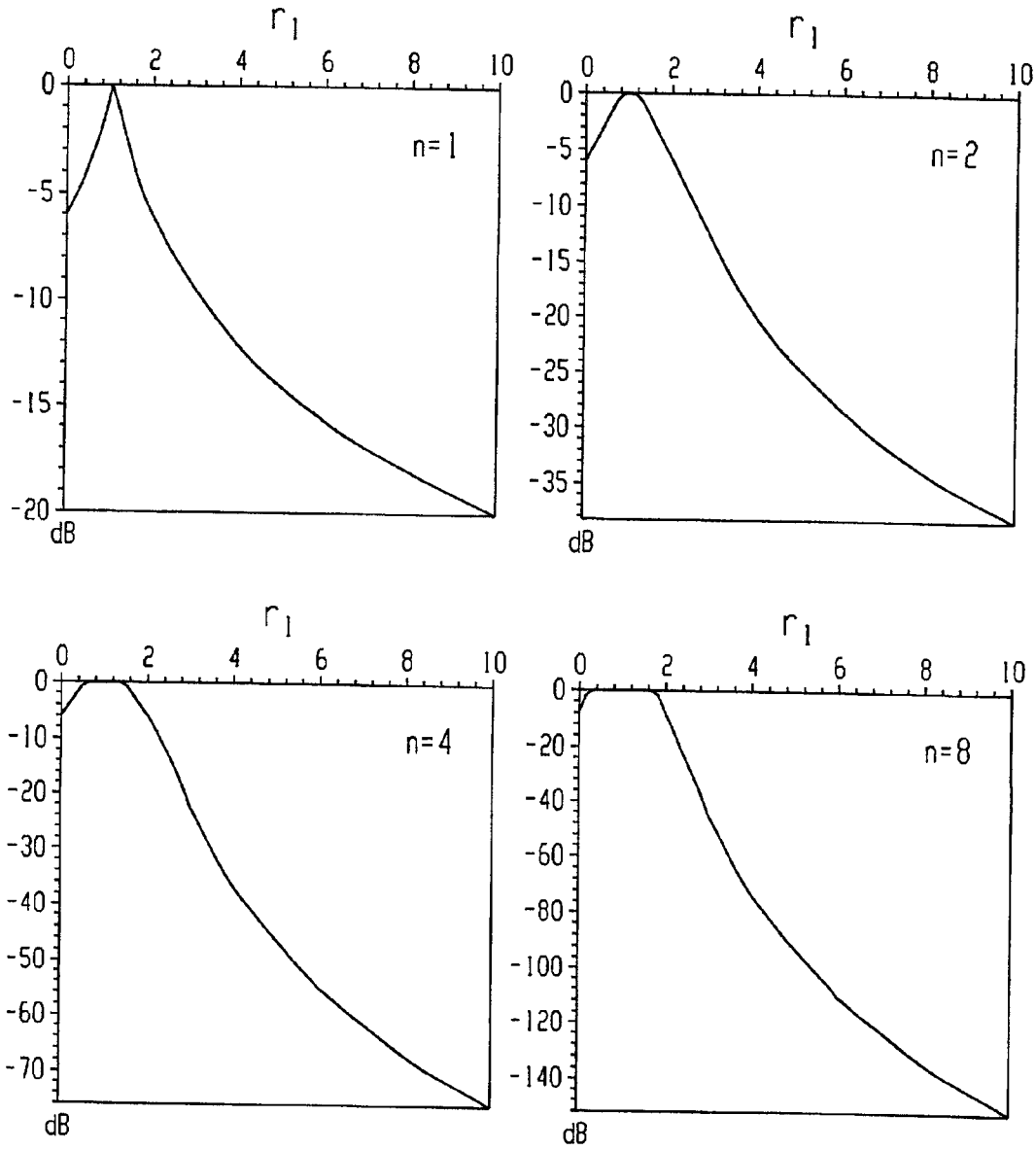
FIG. 3 four amplitude filter functions as preferably applied in the method or system according to FIG. 2 or FIG. 4.

In FIG. 3 the attenuations F are shown for a predetermined frequency f and for $r_o$=1, further with n=1, 2, 4 and 8 respectively.

It goes without saying that the amplitude filter unit 6 is most preferably integrated in calculating unit 4 and is only drawn separately in FIG. 2 for reasons of explanation.

Considering one of the amplitude filter characteristics of FIG. 3 implemented as the filter characteristic of the unit 6 in FIG. 2, it becomes clear that only those components of $S_1$ will be apparent in signal $S_5$, for which there is valid $r_1=r_o$, e.g. appropriately scaled for sources with $r_1$=1 m.

As additionally shown if FIG. 2 it is absolutely possible and often desired to have the filter characteristic of unit 6 made adjustable, so that during operation of the system one can select which area of the acoustical surrounding and with respect to distance shall be monitored.

Figure 4:
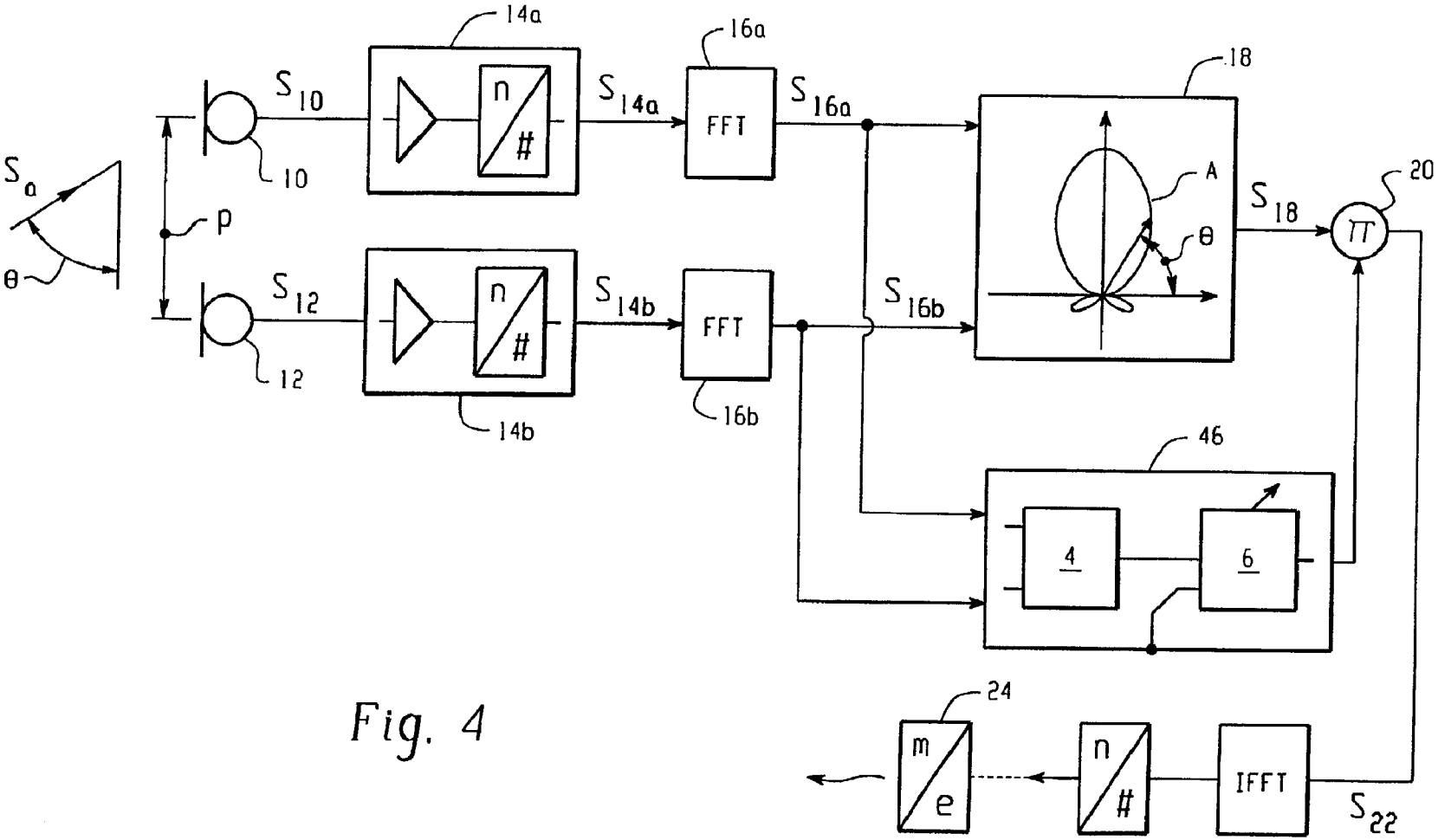
FIG. 4 a preferred realization form of the inventive method at an inventive system for directional and distance-specific discrimination of acoustical sources and as preferably implied in a single hearing aid apparatus or in a binaural hearing aid apparatus system.

In FIG. 4 there is, still schematically, shown a preferred implementation form of the inventive method and of the inventive system, thereby especially as implied in a hearing aid apparatus or in a binaural hearing aid apparatus set. That signal processing is realized after analogue to digital conversion of $S_1$ and $S_2$ and most preferably also after time domain to frequency domain conversion, is quite obvious for the skilled artisan and is also valid at the embodiment of FIG. 2. According to the specific needs, the output signal as of $S_5$ of FIG. 2 is respectively reconverted by frequency domain to time domain conversion and subsequent digital to analogue conversion.

According to FIG. 4*a* matrix of at least two microphones 10 and 12 as of the two microphones of one hearing aid apparatus or of respective microphones at two hearing aid apparatuses of a binaural hearing aid system, which are distant by the respective distance p, generates the respective electric signals $S_{10}$ and $S_{12}$. The electric output signals $S_{10}$, $S_{12}$ are amplified, analogue to digital converted and possibly additionally filtered in unite 14*a* and 14*b*. The output signal $S_{14a}$ and $S_{14b}$ are input to time domain to frequency domain conversion units 16*a* and 16*b*, e.g. Past Fourier Transform units, respectively generating output signals $S_{16a}$, and $S_{16b}$. In a preferred embodiment and especially for hearing aid appliances the two signals $S_{16a}$ and $S_{16b}$ are fed to a beam former unit 18 where, according to one of the well known calculation techniques, beam forming is realized. As schematically shown in the functional block of unit 18, the output signal $S_{18}$ represents principally one of the two signals $S_{16}$, but weighed by a function A, in fact an amplification function which is dependent from the angle θ at which the acoustical signal $S_a$ impinges on the microphone array 10, 12.

Thus, the output signal $S_{18}$ has a directivity selection as determined by the beam shape realized at unit 18. It must be emphasized that the present invention does not dependent from the technique and approach which is taken for realizing beam forming at the unit 18.

As was explained with the help of FIG. 2, the two signals $S_{16a}$ and $S_{16b}$, still representing $S_1$ and $S_2$ according to FIG. 2, are input to the calculation unit 46, wherein the $r_1$ calculation according to unit 4 of FIG. 2 and the amplitude filtering according to the function of amplitude filter unit 6 of FIG. 2, are performed. The output signal of calculation unit 46 weighs at weighing unit 20 signal $S_{18}$. The output signal $S_{22}$ of weighing unit 22 is frequency to time domain and digital to analogue reconverted. In a hearing aid apparatus the resulting output signal is operationally connected via the signal processing unit of the hearing aid apparatus to the electro/mechanical output converter 24 of that apparatus.

Figure 5:
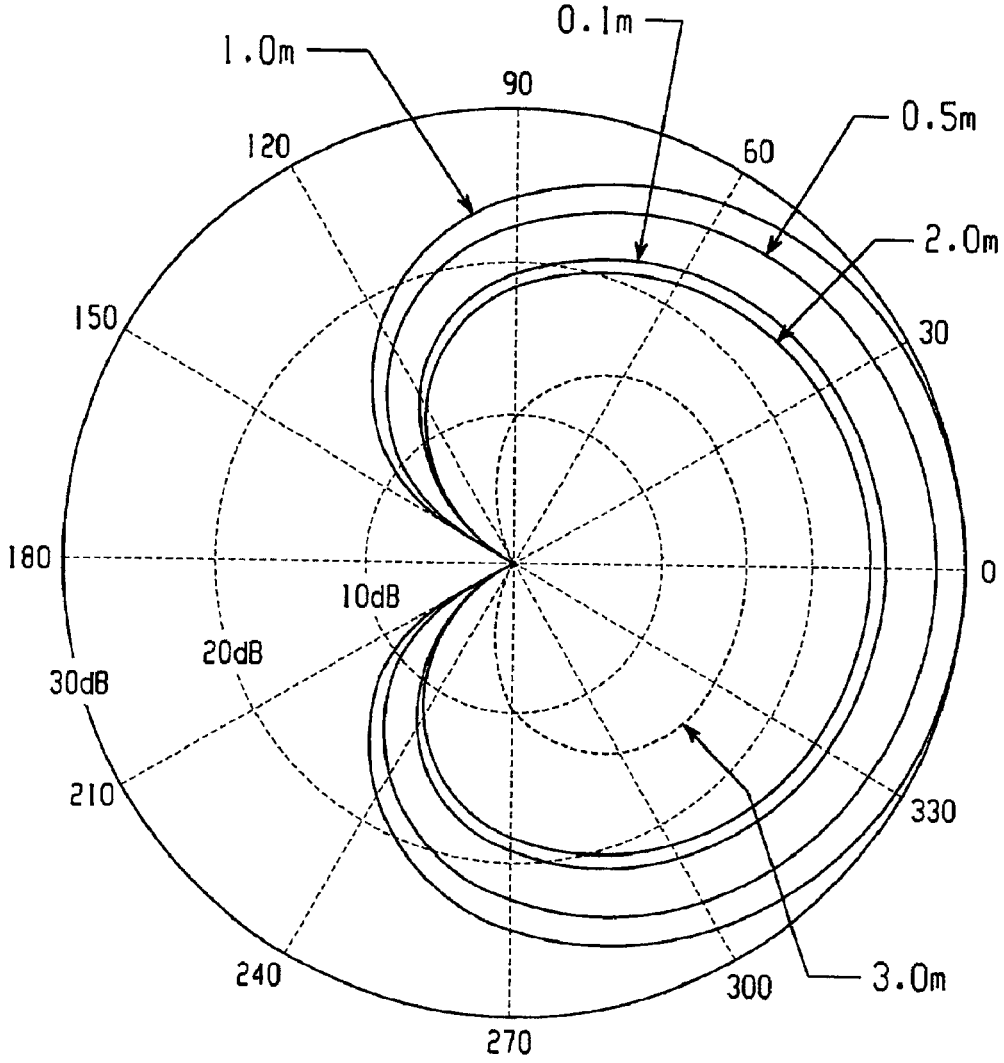
FIG. 5 a directivity and distance selectivity-characteristic with which $S_{22}$ of FIG. 4 depends from impinging angle and distance.

In FIG. 5 there is shown the directivity and distance selection characteristic with which the signal $S_{22}$ of FIG. 4 depends from impinging angle θ as well as from distance $r_1$ if in unit 18 a cardioid beam former is realized, the distance between the microphones p=12 mm and at a frequency of 1 kHz. Thereby, an amplitude filter function according to (18) was realized with $r_o$=1 m and n=2.

What is claimed is:

1. A method for analyzing an acoustical environment comprising acoustical sources located in respective angular directions and at respective radial distances with respect to at least two reception locations, said method comprising the steps of:

registering acoustical signals at said at least two reception locations mutually distant by a given reception distance and generating at least two respective first electric signals representing said acoustical signals;

calculating electronically, from said first electric signals, at least one of the radial distances of sources of acoustical signals in said acoustical environment with respect to at least one of said reception locations, thereby generating a distance signal;

amplitude filtering said distance signal, thereby generating a patterned distance signal;

weighing a signal dependent from at least one of said first signals by said patterned distance signal, thereby generating an output signal representing said acoustical signals from sources distributed in said environment within a radial-distance pattern.

2. The method of claim 1, further comprising performing said calculating according to $$r_1 = \frac{|d|)|S_2|(}{)|S_1|(-)|S_2|(}$$

wherein:

$r_1$: represents a shorter distance of the at least two distances from the at least two locations to an acoustical signal source;

|d|: represents a magnitude of the difference of the distances between said at least two locations and said acoustical signal source;

>$|S_1|$<: represents a first acoustical signal as registered at said one of said at least two locations with said shorter distance from said acoustical signal source, taken its absolute value and averaged over a predetermined amount of time T; and >$|S_2|$<: represents a second acoustical signal as registered at the second location with a larger distance from said acoustical signal source, taken its absolute value and averaged over the predetermined amount of time T.

3. The method of claim 1 or 2, wherein said amplitude filtering is performed by means of at least one band-pass amplitude filtering, passing amplitude values within a predetermined amplitude band.

4. The method of claim 1, thereby generating said signal dependent from said first electric signals by weighing said first electric signals in dependency under which spatial angle the respective acoustical signals impinge at said at least two reception locations.

5. The method of claim 1, further comprising the step of performing said amplitude filtering with an adjustable filter characteristic.

6. The method of claim 1, further comprising the step of performing said registering with at least two microphones of a hearing aid apparatus and/or by at least two microphones, each one of the microphones of a binaural hearing aid system.

7. The method of claim 1, further comprising the step of generating said first electric signals as digital signals.

8. The method of claim 7, further comprising the step of generating said first electric signals as time to frequency domain converted signal.

9. A system for analyzing an acoustical environment comprising:

at least two acoustical to electrical converters mutually distant by a predetermined distance and generating respective first electric output signals at at least two outputs of said converters;

a calculating unit, the inputs thereof being operationally connected to said outputs of said converters and generating at an output a signal which is representative of a distance of an acoustical source in said environment with respect to one of said acoustical to electrical converters;

an amplitude filter unit with an input operationally connected to the output of said calculation unit and generating at an output an output signal which is dependent from a signal to the input of said amplitude filter unit weighed by a function which is dependent from the amplitude of said input signal;

a weighing unit with at least two inputs, one thereof being operationally connected to the output of said amplitude filter unit and the second input thereof being operationally connected to at least one of said outputs of said converters.

10. The system of claim 9, said at least two acoustical to electrical converters being mounted on a single hearing aid apparatus or being mounted to two hearing aid apparatuses of a binaural hearing aid apparatus set.

11. The system of claim 9 or 10, wherein said first electric output signals are led to respective analogue to digital converters and time domain to frequency domain converters before applied to said calculating unit.

12. The system of claim 9, wherein said amplitude filter unit has a band-pass characteristic.

13. The system of claim 9, the amplitude transfer characteristic of said amplitude filter being adjustable.

14. The system of claim 9, wherein said at least two outputs of said converters are operationally connected to a beam former unit, an output of said beam former unit being operationally connected to said second input of said weighing unit.

15. The system of claim 9, wherein an output of said weighingvunit being frequency domain to time domain converted and digital to analogue converted, the output signal of said conversion being operationally connected to an electrical to mechanical transducer of at least one hearing aid apparatus.

16. A method for analyzing an acoustical environment comprising the steps of:

registering acoustical signals at at least two reception locations mutually distant by a given distance and generating at least two respective first electric signals representing said acoustical signals;

calculating electronically, from said first electric signals, at least one of the distances of sources of acoustical signals with respect to at least one of said locations, thereby generating a distance signal;

amplitude filtering said distance signal, thereby generating a patterned distance signal; and weighing a signal dependent from at least one of said first signals by said patterned distance signal, thereby generating an output signal representing said acoustical signals from sources distributed in said environment within a distance pattern, wherein said calculating is performed according to the equation:

$$r_1 = \frac{|d|\rangle|S_2|\langle}{\rangle|S_1|\langle-\rangle|S_2|\langle}$$

wherein:

$r_1$: represents a shorter distance of the at least two distances from the at least two locations to an acoustical signal sources;

$|d|$: represents a magnitude of the difference of the distances between said at least two locations and said acoustical signal source;

$>|S_1|<$: represents a first acoustical signal as registered at said one of said at least two locations with said shorter distance from said acoustical signal source, taken its absolute value and averaged over a predetermined amount of time T; and $>|S_2|<$: represents a second acoustical signal as registered at the second location with a larger distance from said acoustical signal source, taken its absolute value and averaged over the predetermined amount of time T.

* * * * *

UNITED STATES PATENT AND TRADEMARK OFFICE

CERTIFICATE OF CORRECTION

PATENT NO. : 6,947,570 B2
APPLICATION NO. : 09/837050
DATED : September 20, 2005
INVENTOR(S) : Joseph Maisano It is certified that error appears in the above-identified patent and that said Letters Patent is hereby corrected as shown below:

Column 1, line 26: Please delete "no-called", and insert therefor --so-called--.

Column 1, line 38: Please delete "highs", and insert therefor --high,--.

Column 4, line 53: Please delete " $|S_{1 =} S_2|$ ", and insert therefor --$|S_1| = |S_2|$--.

Column 5, line 37: Please delete "egg.", and insert therefor --e.g--.

Column 5, line 39: Please delete "au", and insert therefor--an--.

Column 5, line 49: Please delete "I", and insert therefor --1--.

Column 6, line 23: Please delete "4*a*" and insert therefor--4 a--.

Column 6, line 30: Please delete "unite", and insert therefor --units--.

Column 6, line 32: Please delete "Past", and insert therefor --Fast--.

Signed and Sealed this

Thirteenth Day of February, 2007

JON W. DUDAS
*Director of the United States Patent and Trademark Office*